United States Patent [19]

Hayashi

[11] Patent Number: 5,062,537

[45] Date of Patent: Nov. 5, 1991

[54] BOTTLE-SHAPED CONTAINER WITH BASE CAP

[75] Inventor: Yoshiaki Hayashi, Matsudo, Japan

[73] Assignee: Yoshino Kogyosho Co., Ltd., Tokyo, Japan

[21] Appl. No.: 489,216

[22] Filed: Mar. 6, 1990

[30] Foreign Application Priority Data

Mar. 9, 1989 [JP] Japan ..... 1-26779[U]

[51] Int. Cl.[5] ..... B65D 23/08; B65D 25/24

[52] U.S. Cl. ..... 215/12.1; 215/100 R; 40/310; 248/346.1

[58] Field of Search ..... 215/1 C, 12.1, 12.2, 215/100 R; 40/310; 248/346.1; 220/636

[56] References Cited

U.S. PATENT DOCUMENTS

| | | | |
|---|---|---|---|
| 3,143,243 | 8/1964 | MacKusick | 220/69 |
| 3,482,724 | 12/1969 | Heaton | 215/10 |
| 3,840,141 | 10/1974 | Allom et al. | 220/DIG. 1 X |
| 3,927,782 | 12/1975 | Edwards | 215/100 R |
| 4,138,026 | 2/1979 | Conklin | 215/12.2 |
| 4,241,839 | 12/1980 | Alberghini | 215/100 R |
| 4,326,638 | 4/1982 | Nickel et al. | 215/12.1 |
| 4,436,216 | 3/1984 | Chang | 215/1 C X |
| 4,442,944 | 4/1984 | Yoshino et al. | 215/1 C |
| 4,552,275 | 11/1985 | Chang et al. | 215/100 R X |
| 4,585,679 | 4/1986 | Karabedian | 215/12.2 X |
| 4,612,721 | 9/1986 | Fumei | 40/310 |
| 4,658,974 | 4/1987 | Fujita et al. | 215/100 R X |
| 4,817,806 | 4/1989 | Billoud et al. | 215/12.1 |

FOREIGN PATENT DOCUMENTS

| | | | |
|---|---|---|---|
| 0230816 | 8/1987 | European Pat. Off. . | |
| 259200 | 6/1987 | France . | |
| 61-30982 | 7/1986 | Japan | 215/1 C |
| 658042 | 4/1979 | U.S.S.R. . | |

*Primary Examiner*—Sue A. Weaver

*Attorney, Agent, or Firm*—Oliff & Berridge

[57] ABSTRACT

A bottle-shaped container with a base cap comprises a bottle including a body and a semispherical convex shaped bottom extending downward from the body; and a bottomed cylindrical base cap securely attached to the bottom for providing support for the container; wherein said body has a lower portion thereof having a reduced diameter zone and a tapered zone for preventing a shrunk label attached thereto from slipping out. Gaps are formed between an upper end of an outer periphery of the bottom and an upper end of a cylindrical side wall of the base cap as water inlets. Water outlets are formed in a bottom wall of the base cap for draining hot water from the base cap. An intermediary zone with a vertical dimension is formed on an outer surface of the body between the tapered zone and an upper end of the base cap to enable hot water to flow further down into the base cap through the gaps.

5 Claims, 5 Drawing Sheets

BOTTLE-SHAPED CONTAINER WITH BASE CAP

BACKGROUND OF THE INVENTION

1. Field of the Invention

This invention relates to a blow-molded heat and pressure resistant bottle-shaped container made of biaxially oriented synthetic resin and, more particularly, to the construction of a heat and pressure resistant bottle-shaped container having a semispherical convex bottom for enhancing the pressure resistance thereof and a base cap securely attached to said bottom for providing support for the container.

2. Prior Art

A wide variety of bottle-shaped containers made of biaxially oriented synthetic resin have been popularly used as containers for aerated or carbonated drinks. Particularly, bottles made of biaxially oriented polyethylene terephthalate resin are popular because of their excellent properties such as pressure resistance.

In order to obtain a high pressure resistant bottle requiring less synthetic resin molding material, a bottle having a semispherical bottom has been used. As apparent from the construction of the bottom of the bottle, the bottle is not selfstanding. Thus, a base cap of cylindrical shape for providing a support for the spherical bottom of the container has been associated fixedly with the bottom of the bottle to form the bottle shaped container.

The bottle-shaped container of this type has been imparted with heat resistance by means such as heat setting to achieve sufficient heat resistance against heat at the time of filling the bottle with the content liquid.

When filling the bottle-shaped container with carbonated drink mixed with fruit juice and/or milk as well as other ingredients in the form of mixtures (hereinafter simply referred to as "mixed carbonated drinks"), the container is sealed, and then showered by or bathed in hot water for a predetermined period of time for sterilization by heat.

In order to introduce hot water into a space between the semispherically shaped bottom and the base cap so that an outer surface of the bottom of the bottle covered by the base cap can come into direct contact with hot water and consequently the process of heating and sterilization can be carried out surely and effectively, water inlets are formed. Since a great number of bottles are heated and sterilized, hot water is usually supplied to the bottles in shower state. Thus, said water inlets are normally realized in the form of many gaps arranged between an open end of the base cap and the outer surface of the bottle so that such gaps offer ease of introducing the hot water running from above along the outer surface of the bottle-shaped container into the space.

The above described arrangement of providing water inlets in the form of many gaps between the base cap and the outer surface of the body of the bottle is advantageous because the hot water supplied in the shower state runs down along the outer surface of the body of the bottle and goes into the space between the bottom of the container and the base cap through the water inlets surely and smoothly, and such water inlets can be formed very easily.

A bottle-shaped container of this type is attached around the body with a shrunk label which is made of heat-shrinking synthetic resin film for the purpose of protecting the contained mixed carbonated drink, indicating the content of the bottle and decorating the appearance of the container. This container is provided with ridges integrally formed with the bottle on the outer surface of its body for preventing the shrunk label from slipping out. One of the ridges is formed at the lower end of the body or at the boundary between the body and the bottom of the bottle and therefore located immediately above the gaps between the outer surface of the bottle and the base cap.

When the ridge is located immediately above the gaps as described above, the hot water running down along the outer surface of the bottle is inevitably moved radially as it passes over the ridge and can hardly go into the gaps located immediately therebelow so that consequently the bottom of the bottle may not be sufficiently heated.

Particularly, when the slipping out of the shrunk label is prevented by a shoulder with a reduced diameter and a ridge formed at the lower end of the body, the lower end of the shrunk label that surrounds the body reaches beyond the ridge and blocks the gaps of water inlets. Thus, the operation for applying and attaching the shrunk label to the bottle-shaped container has to be conducted not by the container manufacturer but by the drink producer after sterilization of the liquid content. Therefore, not only an increased number of operational steps but also installation of additional equipment for applying and bonding shrunk labels are necessary for the drink producer so as to push up the cost of the bottled final products.

SUMMARY OF THE INVENTION

In view of the above described problem of the prior art, it is therefore one object of the present invention to provide a bottle-shaped container that ensures introduction of hot water running down along the outer surface of the body of the container into gaps provided between the bottle and the base cap as water inlets. Another object of the present invention is to provide a bottle-shaped container that ensures introduction of the hot water into the gaps regardless of the existence or non-existence of a shrunk label.

According to the invention, the above object is achieved by providing a bottle-shaped container with a base cap comprising: a bottle including a body and a semispherical convex bottom extending downward from the body; and a bottomed cylindrical base cap securely attached to the bottom of the container for providing a support for the container; wherein said body has a lower portion thereof having a reduced diameter zone and a tapered zone for preventing a shrunk label attached thereto from slipping out. Gaps are formed between an upper end of an outer periphery of the bottom and an upper end of a cylindrical side wall of the base cap as water inlets. Water outlets are formed in a bottom wall of the base cap for draining hot water from the base cap. An intermediary zone with a vertical dimension is formed on an outer surface of the body between the tapered zone and an upper end of the base cap to enable hot water to flow further down into the base cap through the gaps.

The gaps are advantageously realized by forming vertical ridges arranged on an inner peripheral surface of the cylindrical side wall of the base cap. However, means for forming the gaps is not limited to this construction. It is preferable that a height of the tapered zone is approximately equal to a distance between the outer periphery of the upper end of the bottom and an outer periphery of the upper end of the base cap. It is also preferable that a gradient of said tapered zone is such that the hot water running down along the outer surface of the bottle may not drop straight downward from the outer surface. A lower end of the shrunk label attached to the bottle is advantageously arranged within an intermediary zone with a vertical dimension.

When a hermetically sealed bottle containing a mixed carbonated drink is subjected to a shower of hot water, the hot water runs down along the surface by its own weight, keeping contact with the surface, while heating the outer surface of the bottle. The hot water runs down along the outer surface of the bottle and eventually flows across the tapered zone of the body, where it tends to lose contact with the surface of the body of the bottle. However, the intermediary zone covering a predetermined distance between the tapered zone and the upper end of the base cap is so formed that the hot water can regain contact with the outer surface of the bottle because of an ability of water to adhere to the outer surface of the bottle. Therefore, after the hot water flows across the tapered zone, the water can keep a close contact with the outer surface of the bottle and eventually get to the gaps.

Since the gaps of the water inlets are formed between the outer surface of the bottle and the inner surface of the upper end portion of the base cap, the hot water coming down along the outer surface of the bottle can enter the base cap through the gaps without encountering obstacles while still keeping contact with the outer surface of the bottle.

Since the water in the base cap is gradually drained through the water outlets, additional hot water is always maintained in the base cap so that the bottom of the bottle is effectively heated.

Because the hot water supplied to the outer surface of the bottle in shower state always contacts the outer surface of the bottle, it directly heats the entire area of the outer surface of the bottle by the time it reaches the lower end of the bottom of the bottle. Since the gaps are arranged between the outer surface of the bottle and the inner periphery of the upper end portion of the base cap and an intermediary zone having the predetermined distance is provided between the upper end of the base cap and the tapered zone, the hot water can be smoothly and efficiently introduced into the base cap so as to heat the bottom of the bottle effectively.

PREFERRED EMBODIMENT OF THE INVENTION

Figure 1:
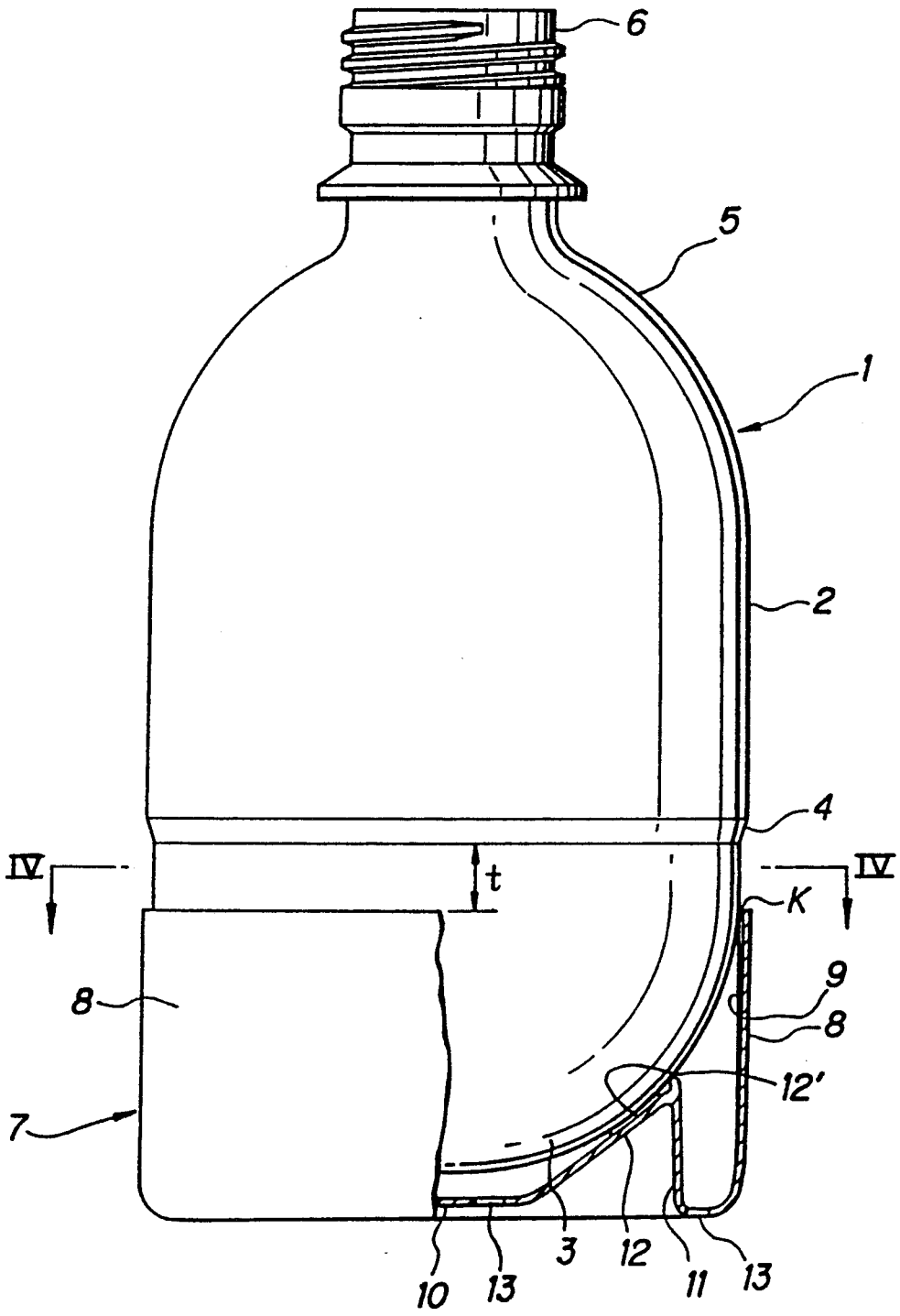
FIG. 1 is a front view of an embodiment of the invention showing a part of the base cap in section.
Figure 2:
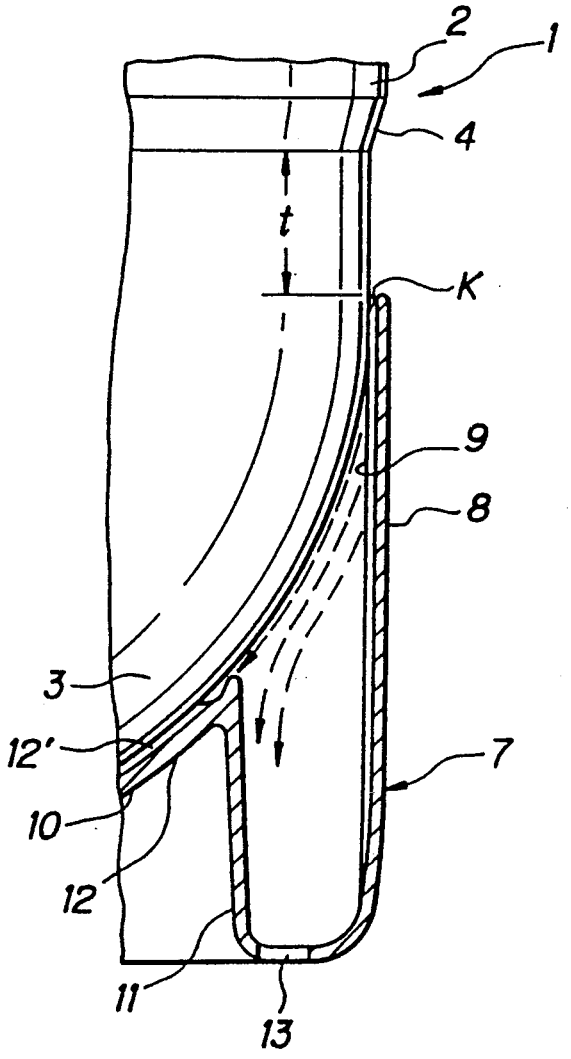
FIG. 2 is an enlarged sectional view showing the area connecting the bottle main body and the base cap.

Now the present invention will be described in greater detail by referring to the accompanying drawings that illustrate a preferred embodiment of the invention.

A bottle 1 is constituted by a cylindrical body 2 having a tapered zone 4 so that a portion of the body below the tapered zone has a reduced diameter, a semispherical and convex shaped bottom 3 extending downwardly from a lower end of the body 2, an arched and tapered shoulder 5 extending upwardly from an upper end of said body 2 and a neck 6 having a threaded outer surface and extending upwardly from an upper end of said shoulder 5.

Figure 3:
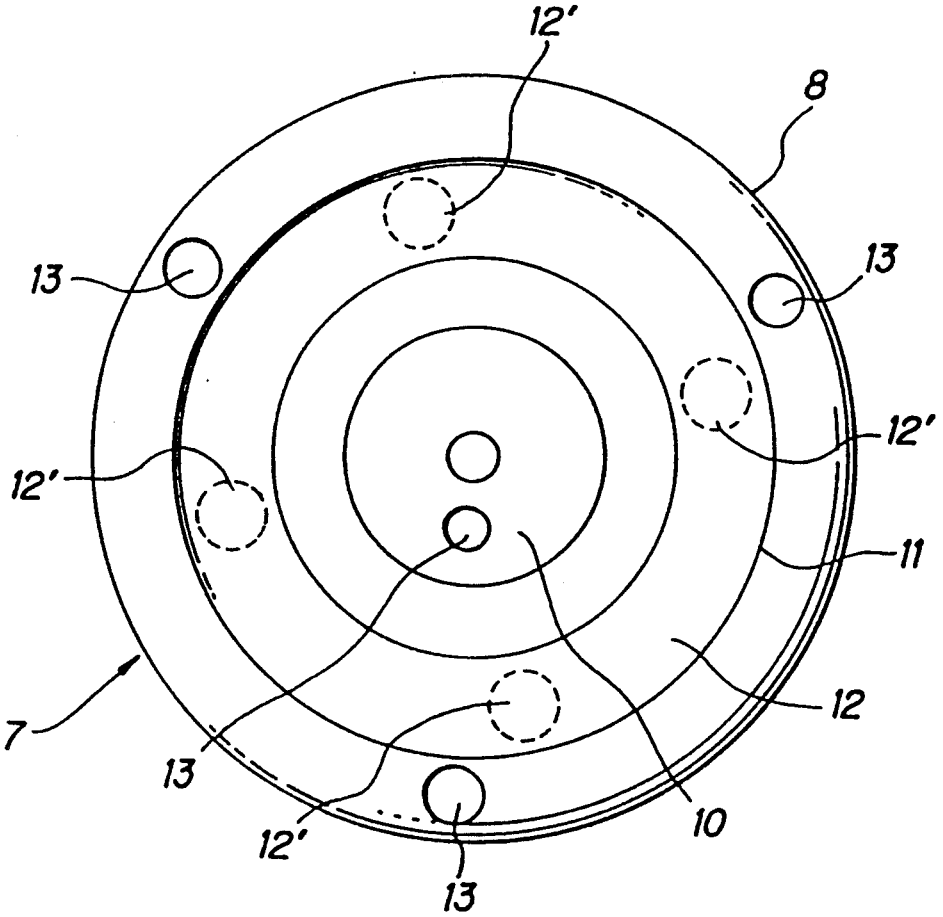
FIG. 3 is a bottom view of the bottom of the base cap.
Figure 4:
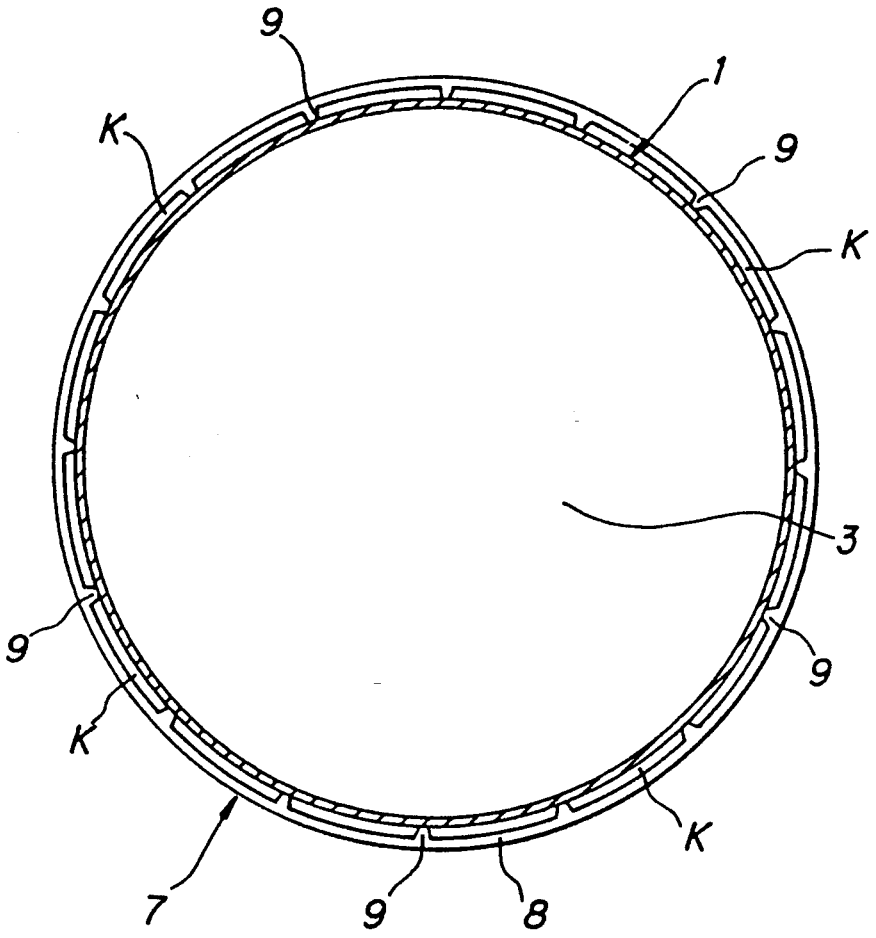
FIG. 4 is a sectional view of the embodiment of FIG. 1 cut along line IV—IV.

A base cap 7 is attached to the bottom 3 in a snap fitting manner and has a bottomed cylindrical shape. The base cap 7 has a cylindrical side wall 8 and a bottom wall 10 at a lower end of the side wall 8. An outer diameter of the side wall 8 is equal to an outer diameter of the body 2. A plurality of inwardly projected longitudinal ridges 9 are formed on an inner peripheral surface of the cylindrical side wall 8 from an upper end to the lower portion of the side wall 8. A height of said ridges 9 is equal to a width of gaps K. The bottom wall 10 has a narrow peripheral portion arranged adjacent to the lower end of the cylindrical side wall 8 to provide a support for the bottle, a cylindrical supporting wall 11 extending upwardly from said narrow peripheral portion, and a central portion. A supporting wall portion 12 is an inclined portion between said cylindrical support wall 11 and the central portion. The base cap 7 is bonded to an outer peripheral surface of the bottom 3 at selected points on the supporting wall portion 12. In the illustrated embodiment, the bottom 3 and the supporting wall portion 12 are bonded by hot melt adhesive at four points 12' as indicated in the FIG. 3. An adhesive layer 12' has a thickness so that gaps are provided between the bottom 3 and the supporting wall portion 12. Thus, hot water can flow into the central portion of the bottom wall 10. Water outlets 13 are formed in the support and the central portion of the bottom wall 10. In the illustrated embodiment, three water outlets 13 are formed in the narrow peripheral portion and one water outlet 13 is formed in the central portion of the bottom wall 10.

An outer diameter of the cylindrical side wall 8 of the base cap 7 is equal to that of the body 2 of the bottle 1. Thus, the bottle-shaped container has a very simple and plane appearance and can be securely kept standing when a large number of bottle-shaped containers are arranged adjacent to each other. The gaps K are formed by means of the ridges 9. Thus, the total area of the gaps K for introducing hot water can be sufficiently large. An outer surface of the bottle 1 is utilized to define the gaps K. Thus, the flowing hot water can smoothly enter the gaps without encountering obstacles.

An angle of the tapered zone 4 with a longitudinal axis of the bottle 1 is relatively small (between 22° and 30° ). Thus, it is prevented sufficiently that the hot water flowing down along the outer surface of the bottle 1 releases from the outer surface at the tapered zone 4 to fall straight downward. Therefore, the hot water enters the gaps K.

Figure 5:
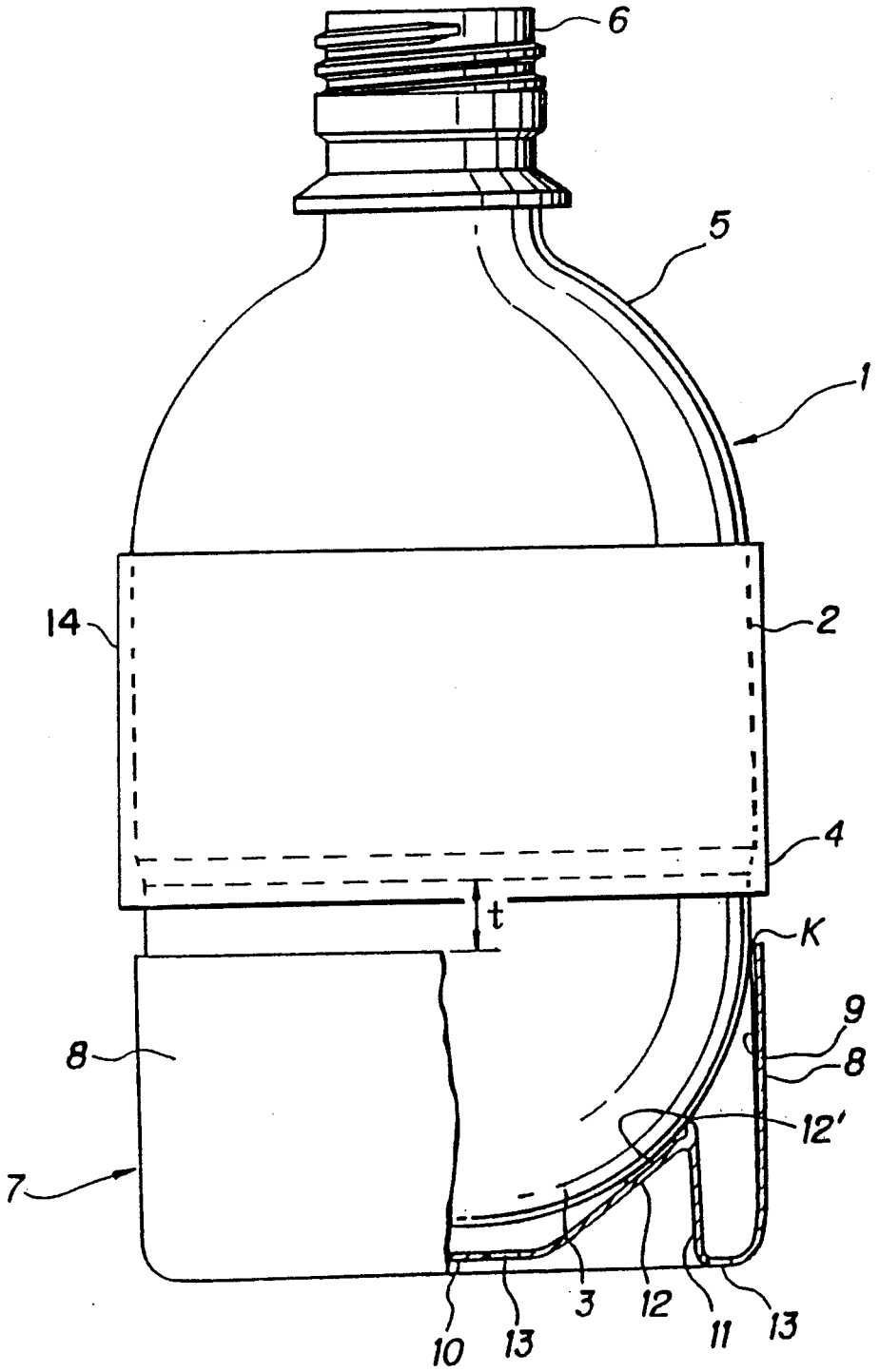
FIG. 5 is a front view of the embodiment of FIG. 1 in which a label is affixed to the bottle.

An intermediary zone is formed on the body 2 of the bottle 1 between an upper end of the base cap 7 and the tapered zone 4 with a longitudinal distance t. Thus, a lower end of a shrunk label 14 attached around the body 2 of the bottle 1 (see FIG. 5) can be placed somewhere in this zone with the distance t so that the shrunk label cannot constitute an obstacle for the hot water flowing down to enter into the gaps. Therefore, the shrunk label can be fitted to the bottle-shaped container in the container manufacturer's facility so that the drink producer may not be required to introduce additional operational steps and install additional equipment which are obviously out of the scope of his profession.

A bottle-shaped container according to the invention which is constructed in a manner as described above can provide the following effects.

Since the hot water supplied to the outer surface of the bottle flows down to the outer surface of the bottom of the bottle through the gaps in a secured and smooth manner, the liquid content of the container can be heated and sterilized surely and effectively.

Since the lower end of the shrunk label attached around the bottle can be placed in the intermediary zone between the tapered zone and the upper end of the base cap, the attached shrunk label never constitutes an obstacle that prevents the hot water from entering the gaps.

Since the shrunk label can be attached to the bottle in the container manufacturer's facility, the drink producer is not required to introduce any additional work and facility for attaching the shrunk label to the bottle and therefore can reduce the cost and improve the quality of the product.

Since the bottle-shaped container can have a simple appearance and be stably kept in its standing position during transportation, the operations of filling it with liquid and sterilization can be conducted securely and effectively.

What is claimed is:

1. A bottle-shaped container with a base cap comprising:

a bottle including a body and a semispherical convex shaped bottom extending downward from the body; and a cylindrical base cap securely attached to said bottom, said base cap providing support for the container; wherein said body has a lower portion having a reduced diameter zone and a tapered zone for preventing a shrunk label attached thereto from slipping;

inlet means are formed between an outer periphery of an upper portion of the bottom and an inner periphery of an upper end of a cylindrical side wall of the base cap;

outlet means are formed in a bottom wall of the base cap for draining hot water from the base cap; and an intermediary zone is formed on an outer surface of the body between the tapered zone and said upper end of the base cap to enable hot water to flow into the base cap through said inlet means.

2. The bottle-shaped container according to claim 1, wherein said inlet means are defined by vertical ridges arranged on an inner peripheral surface of the cylindrical side wall of the base cap.

3. The bottle-shaped container according to claim 1, wherein a height of the tapered zone, defined as the difference between the radius of said bottle above said tapered zone and the radius of said bottle in said intermediary zone, is approximately equal to a distance between the outer periphery of said upper portion of the bottom and an outer periphery of said upper end of said base cap.

4. The bottle-shaped container according to claim 1, wherein a gradient of said tapered zone is such that hot water running down along the outer surface of the bottle does not drop straight downward from the outer surface.

5. The bottle-shaped container according to claim 1, further comprising a shrunk label attached to the bottle such that a lower end of said label is arranged within said intermediary zone.

* * * * *